US006376451B1

(12) United States Patent
Teasdale et al.

(10) Patent No.: US 6,376,451 B1
(45) Date of Patent: Apr. 23, 2002

(54) HARD SURFACE CLEANING COMPOSITION

(75) Inventors: Steve Teasdale, Otterburn Park; Corinne Lafrance, St-Amable, both of (CA)

(73) Assignee: Innu-Science 2000 Inc., Ste-Julie (CA)

( * ) Notice: Subject to any disclaimer, the term of this patent is extended or adjusted under 35 U.S.C. 154(b) by 0 days.

(21) Appl. No.: 09/692,465

(22) Filed: Oct. 20, 2000

(51) Int. Cl.[7] ..... C11D 3/02; C11D 7/02; C11D 3/386

(52) U.S. Cl. ..... 510/392; 510/392; 510/320; 510/462; 435/188

(58) Field of Search ..... 510/392, 320, 510/462; 435/188

(56) References Cited

U.S. PATENT DOCUMENTS

| | | | | |
|---|---|---|---|---|
| 5,422,030 A | * | 6/1995 | Panandiker et al. | 252/135 |
| 5,665,587 A | * | 9/1997 | Aaslyng et al. | 435/221 |
| 5,863,882 A | | 1/1999 | Lin et al. | 510/397 |
| 5,931,172 A | | 8/1999 | Steer et al. | 134/22.13 |

* cited by examiner

*Primary Examiner*—Lorna M. Douyon
*Assistant Examiner*—Eisa Elhilo
(74) *Attorney, Agent, or Firm*—George A. Seaby

(57) ABSTRACT

An aqueous hard surface cleaning composition contains anionic and nonionic surfactants, an enzyme mixture such as lipase/alpha-amylase for breaking down organic compounds; an activator for rendering the enzyme more active; a nonpathogenic bacteria such as a culture of *Bacillus subtilis* and *Bacillus amyloliquefaciens* for degrading and assimilating organic compounds; and water.

8 Claims, No Drawings

HARD SURFACE CLEANING COMPOSITION

BACKGROUND OF THE INVENTION

1. Field of the Invention

This invention relates to a hard surface cleaning composition, and in particular to an aqueous floor cleaning composition.

While the composition of the present invention is primarily intended for cleaning restaurant kitchen floors, the composition can be used to clean other solid surfaces such as the floors of food processing plants which are subject to food and/or grease soiling.

2. Discussion of the Prior Art

Slipping and falling by persons working in restaurant kitchens is not uncommon. In fact, most restaurant kitchen injuries are the result of falling. Slipping occurs on wet floors, on food on the floors and especially on fat near frying equipment. Commercially available chemical degreasers remove some fat from floor surfaces, but are not particularly effective at removing fat from grout or other porous surfaces. The result is speeding re-soiling of floors immediately following cleaning.

GENERAL DESCRIPTION OF THE INVENTION

An object of the present invention is to provide a hard surface cleaning composition for such floors which effectively degreases an entire floor area including tile grout and porous surfaces.

Another object of the invention is to provide a hard surface cleaning composition which is progressively active, i.e. continues to be active over a relatively long period of time after being applied to a surface.

GENERAL DESCRIPTION OF THE INVENTION

In general terms, the composition of the present invention includes at least one surfactant; an enzyme mixture for breaking down organic compounds such as fats, oils, grease and starch; nonpathogenic bacteria for degrading and assimilating organic compounds such as fats, oils and greases, starch and proteins; and water.

More specifically, the invention provides an aqueous hard surface, liquid cleaning composition containing an anionic and a nonionic surfactant; an enzyme mixture such as lipase (triacylglycerol acylhydrolase, E.C.3.1.1.3)/alpha-amylase (E.C.3.2.1.1); an enzyme activator such as calcium chloride dihydrate for rendering the enzymes more active; nonpathogenic Bacillus bacteria; a stabilizer such as anhydrous sodium acetate; a buffer such as tris (hydroxymethyl) aminomethane and water.

The surfactants ensure good bioavailability of the dirt, working instantly when the composition is applied to a surface. The calcium chloride dihydrate stabilizes the lipase and removes free fatty acids from the reaction system by the formation of $Ca^{2+}$ salt, thereby preventing inhibition of the enzyme and reassociation of the free fatty acids with hydrolyzed fat molecules (diglycerides, monoglycerides and glycerol).

In addition to lipase, the composition can also contain an alpha-amylase, which broadens the cleaning activity of the formulation. The enzymes break down the organic compounds on the hard surface. The enzyme lipase catalyzes the hydrolysis of triacylglycerides (fats) into diglycerides, monoglycerides, free fatty acids and glycerol. The enzyme alpha-amylase catalyzes the hydrolysis of polysaccharides such as starch into smaller sugars such as maltose. The activity of the enzymes are immediate and long lasting, starting as soon as the composition is applied to the surface being treated and lasting as long as the enzymes are in good condition and not retroinhibited by accumulation of metabolites. Amylase enzyme will also keep active as long as a minimum of dampness is maintained on the surface and in the tile grout or other cracks. The lipase activity is independent of dampness and can be active even in low water activity conditions. In tile grout, the activity can last for hours. The enzyme mixture is lipolytic and amylolytic, but not proteolytic, since the latter activity would work against enzyme protein.

The bacteria used in the composition (*Bacillus subtilis* and *Bacillus amyloliquefaciens*) play a major role in the composition described herein. The activity of the bacteria is progressive, i.e. the bacteria can take up to three hours to become fully active, and the bacterial activity can last up to twenty-four hours in normal humidity. The smaller molecules produced by the hydrolysis of the complex organic compounds by the enzyme mixture become available for the bacteria. Then the bacteria will start growing and producing their own lipase and amylase enzymes, becoming very effective at degrading various organic compounds including fats and starch.

DESCRIPTION OF THE PREFERRED EMBODIMENT

A preferred composition is set out in the following table.

TABLE

| INGREDIENT | FUNCTION | WEIGHT PERCENT Range | WEIGHT PERCENT Preferred |
|---|---|---|---|
| Water | solvent | 50–65 | 61.04 |
| Dodecylbenzene sulfonic acid | anionic surfactant | 10–30 | 15.00 |
| Ethoxylated propoxylated $C_{12}$–$C_{15}$ alcohols | nonionic surfactant | 10–30 | 15.00 |
| Sodium hydroxide (50%) | neutralizer for dodecylbenzene sulfonic acid | 2–8 | 4.02 |
| Tris(hydroxymethyl) aminomethane | buffer | 0–4 | 0.30 |
| Anhydrous sodium acetate | stabilizer | 1–5 | 2.40 |
| Lipase/Alpha-amylase | enzyme | 0.1–5 | 1.80 |
| Hydrochloric acid | pH control | 0–1 | 0.1 |
| Calcium chloride dihydrate | activator | 0.02–0.5 | 0.05 |
| 1,2-benzisothiazolin-3-one | preservative | 0.03–0.2 | 0.08 |
| Lime green | colorant | 0–0.1 | 0.0016 |

TABLE-continued

| INGREDIENT | FUNCTION | WEIGHT PERCENT Range | Preferred |
|---|---|---|---|
| Citrus fragrance | perfume | 0.1–1.5 | 0.1 |
| *Bacilius subtilis* and *Bacillus amyloliquefaciens* | bacteria ($2.10^7$ cfu/ml) | 0.1–10 | 0.1 |

The anionic surfactant dodecylbenzene sulfonic acid is manufactured by Stepan, and the nonionic surfactant available under the trade-mark ANTAROX LAEP59 is manufactured by Rhone Poulenc. The anhydrous sodium acetate used to stabilize the enzyme is produced by Macco, and the enzyme mixture is obtained from Innu-science Canada Inc. The 1,2-benzisothiazolin-3-one, which inhibits the growth of spores, fungi or other possibly contaminating bacteria in the composition is manufactured by Avicia. The colorant is made by Warner Jenkinson, and the perfume by Ess. et Frag. Bell. The Bacillus bacteria is obtained in a culture with a final bacterial concentration of $2\times10^7$ cfu/ml. Before being introduced into the formulation, the bacterial culture must be washed at least twice to ensure that no residual proteolytic activity is introduced into the formulation. The culture was obtained from Innu-science Canada Inc. The hydrochloric acid is used to adjust the pH of the composition to 6.5–9.0, preferably 8.2–8.5.

As mentioned above, the composition is primarily intended for use on kitchen floors. In commercial or other high use kitchens, the floor should be cleaned at least once a day using a mop. The composition is diluted with warm water at approximately 40° C. (avoid hot water which adversely affects the structure of the enzymes, rendering them inactive), using approximately 50 parts by volume of water for 1 part composition. The dilution proportions are critical for optimal activity. The formulation should be diluted with 40 to 60 parts by volume of water (50 parts of water being optimal). Any deviation from this range adversely affects the cleaning activity of the composition.

As well as kitchen floors, the composition of the present invention can be used on any floor subjected to food soilage. For example, the composition provides a unique cleaning ability for concrete floors such as those found in garbage rooms, merchandise receiving areas and loading docks.

We claim:

1. A liquid, hard surface cleaning composition comprising a surfactant; an enzyme mixture for breaking down organic compounds; an enzyme activator for rendering the enzyme mixture more active; 0.1 to 10% by weight of the composition a nonpathogenic Bacillus bacteria and water.

2. The cleaning composition of claim 1, including an anionic and a nonionic surfactant.

3. The cleaning composition of claim 2, wherein said enzyme mixture contains lipase and amylase.

4. The cleaning composition of claim 3, wherein said enzyme activator is calcium chloride dihydrate.

5. The cleaning composition of claim 1 wherein said bacteria is a mixture of *Bacillus subtillis* and *Bacillus amyloliquefaciens.*

6. An aqueous, hard surface cleaning composition comprising an anionic and a nonionic surfactant; a neutralizer for the anionic surfactant; a buffer; a stabilizer; an enzyme mixture for breaking down organic compounds; an enzyme activator for rendering the enzyme more active; an inorganic acid for adjusting the pH of the composition; a preservative and a Bacillus bacteria for degrading and assimilating organic compounds.

7. An aqueous hard surface cleaning composition comprising, by weight, 10–30% dodecylbenzene sulfonic acid; 10–30% ethoxylated propoxylated $C_{12}$–$C_{15}$ alcohols; 2–8% sodium hydroxide; 0–4% tris(hydroxymethyl) aminomethane; 1–5% anhydrous sodium acetate; 0.1–5% lipase/alpha-amylase mixture; 0–1% hydrochloric acid; 0.02–0.5% calcium chloride dihydrate; 0.03–0.2% 1,2-benzisothiazolin-3-one; 0.1–10% of a culture of *Bacillus subtilis* and *Bacillus amyloliquefaciens;* and 50–65% water.

8. An aqueous, hard surface cleaning composition comprising, by weight, 15% dodecylbenzene sulfonic acid; 15% ethoxylated propoxylated $C_{12}$–$C_{15}$ alcohols; 4.02% NaOH; 0.30% tris(hydroxymethyl) aminomethane; 2.40% anhydrous sodium acetate; 1.80% lipase/alpha-amylase mixture; 0.1% hydrochloric acid; 0.05% calcium chloride dihydrate; 0.08% 1,2-benzisothiazolin-3-one; 0.1% of a culture of *Bacillus subtilis* and *Bacillus amyloliquefaciens;* and 61.04% water.

* * * * *